US005622671A

United States Patent [19]

Pellegrin et al.

[11] Patent Number: 5,622,671

[45] Date of Patent: Apr. 22, 1997

[54] HOLLOW POLYMER FIBERS USING ROTARY PROCESS

[75] Inventors: Michael T. Pellegrin; James E. Loftus, both of Newark; Randall M. Haines, Frazeysburg; Virgil G. Morris; Patrick L. Ault, both of Newark; Larry J. Huey, Granville, all of Ohio

[73] Assignee: Owens-Corning Fiberglass Technology, Inc., Summit, Ill.

[21] Appl. No.: 570,954

[22] Filed: Dec. 12, 1995

[51] Int. Cl.[6] ..... D01D 5/18; D01D 5/24

[52] U.S. Cl. ..... 264/563; 264/209.2; 264/211.1

[58] Field of Search ..... 264/209.2, 211.1, 264/563

[56] References Cited

U.S. PATENT DOCUMENTS

| | | | |
|---|---|---|---|
| 3,400,189 | 9/1968 | Nacke | 264/209.2 X |
| 3,962,094 | 6/1976 | Davis et al. . | |
| 4,246,017 | 1/1981 | Phillips . | |
| 4,296,164 | 10/1981 | Bemis et al. . | |
| 4,526,597 | 7/1985 | Olinger et al. . | |
| 4,622,054 | 11/1986 | Huey et al. . | |
| 4,758,259 | 7/1988 | Jensen . | |
| 4,762,749 | 8/1988 | Schuetz . | |
| 4,833,013 | 5/1989 | Schuetz . | |
| 4,844,809 | 7/1989 | Ashing et al. . | |
| 4,846,864 | 7/1989 | Huey . | |
| 4,853,001 | 8/1989 | Hammel . | |
| 4,917,715 | 4/1990 | Kaveh et al. . | |
| 4,937,020 | 6/1990 | Wagner et al. . | |
| 4,941,904 | 7/1990 | Barch et al. . | |
| 5,242,633 | 9/1993 | Rook et al. . | |
| 5,312,469 | 5/1994 | Houston . | |
| 5,326,241 | 7/1994 | Rook et al. . | |
| 5,431,992 | 7/1995 | Houpt et al. . | |

FOREIGN PATENT DOCUMENTS

| | | | |
|---|---|---|---|
| 339124 | 11/1989 | European Pat. Off. . | |
| 62-125016 | 6/1987 | Japan | 264/211.1 |
| 94/3661 | 2/1994 | WIPO . | |

*Primary Examiner*—Leo B. Tentoni

*Attorney, Agent, or Firm*—C. Michael Gegenheimer; Curtis B. Brueske

[57] ABSTRACT

In a method for producing hollow polymer fibers, molten polymer is supplied to a rotating polymer spinner having a peripheral wall. The spinner rotates so that molten polymer is centrifuged through a first tube extending through the peripheral wall of the spinner to form fibers. Gas is introduced into the interior of the molten polymer to form hollow polymer fibers. The hollow polymer fibers are then collected as a product such as a mat. The hollow polymer fibers produced by the method are microfibers having an average outside diameter of from about 2.5 microns to about 62.5 microns.

18 Claims, 5 Drawing Sheets

HOLLOW POLYMER FIBERS USING ROTARY PROCESS

TECHNICAL FIELD

This invention relates in general to the manufacture of polymer fibers, and specifically to a method for manufacturing hollow polymer fibers by a modified rotary process.

BACKGROUND ART

In the past, solid polymer fibers have traditionally been made on a stationary spinneret from which fibers are pulled or drawn. This is known as a "textile process". It is also known to make hollow polymer fibers using a textile process. They are lighter in weight than solid polymer fibers having the same length and diameter. Because they can often provide the same performance at reduced weight, hollow polymer fibers are sometimes more useful in certain applications than solid polymer fibers. For example, the reduced weight is particularly desirable when the hollow polymer fibers are used as apparel insulation fibers and in certain other insulation applications. Unfortunately, the textile process for making hollow polymer fibers has a limited throughput, because the process relies solely on mechanical attenuation to form the molten polymer into fibers.

Polymer microfibers are very small diameter fibers that are particularly suited for certain applications such as thermal and acoustical insulation, absorbent products and filtration products. The textile process is not well adapted for making polymer microfibers because there is a limit on how small the diameter of the fibers can be formed with mechanical attenuation. It is known to make solid polymer microfibers by a melt blowing process which utilizes a stream of air to attenuate the fibers. However, it is not known to make hollow polymer microfibers by the melt blowing process. The stream of air attenuating the fibers would likely interfere with the introduction of gas inside the fibers to make hollow fibers. Further, the melt blowing process is very expensive. Thus current polymer technology does not provide a way to make directly spun hollow polymer microfibers.

Therefore, it would be desirable to provide a process for making hollow polymer fibers that has a higher throughput than the textile process. It would particularly be desirable to provide a process for making hollow polymer microfibers.

DISCLOSURE OF THE INVENTION

This invention relates to a method for producing hollow polymer fibers. In the method, molten polymer is supplied to a rotating polymer spinner having a peripheral wall. The spinner rotates so that molten polymer is centrifuged through a first tube extending through the peripheral wall of the spinner to form fibers. Gas is introduced into the interior of the molten polymer to form hollow polymer fibers. Preferably the gas is introduced through a second tube. The hollow polymer fibers are then collected to form a product, such as a mat.

This rotary process for making hollow polymer fibers has a higher throughput than a textile process. It achieves a high throughput by using centrifugal force to form fibers through the peripheral wall of the spinner.

Advantageously, the hollow polymer fibers formed by this process are microfibers. The centrifugal attenuation of the molten polymer by the rotation of the spinner is sufficient to form the desired small diameter of microfibers. The hollow polymer microfibers have an average outside diameter of from about 10 one-hundred thousandths of an inch (about 2.5 microns) to about 250 one-hundred thousandths of an inch (about 62.5 microns).

It was not apparent before this invention that hollow polymer fibers could be made by a rotary process, particularly hollow polymer microfibers. It is known to manufacture larger, solid polymer fibers by a rotary process. However, the manufacture of hollow fibers is significantly different from the manufacture of solid fibers. Various processes are known for manufacturing glass fibers. However, the manufacture of glass fibers is a different field from the manufacture of polymer fibers. The two materials have different physical properties such as viscosities and densities.

The hollow polymer microfibers in accordance with this invention can make a mat with high loft (nonwoven). Thus, the fibers provide excellent performance in a wide variety of applications including, for example, absorbent products, acoustical and thermal insulation products, textiles, and filtration products. The performance of the hollow polymer fibers is kept constant or improved relative to solid polymer fibers. At the same time, the hollow polymer fibers are reduced in weight from about 10% to about 80%, preferably from about 25% to about 50%, compared to solid polymer fibers.

Various objects and advantages of this invention will become apparent to those skilled in the art from the following detailed description of the preferred embodiment, when read in light of the accompanying drawings.

BEST MODE FOR CARRYING OUT THE INVENTION

Figure 1:
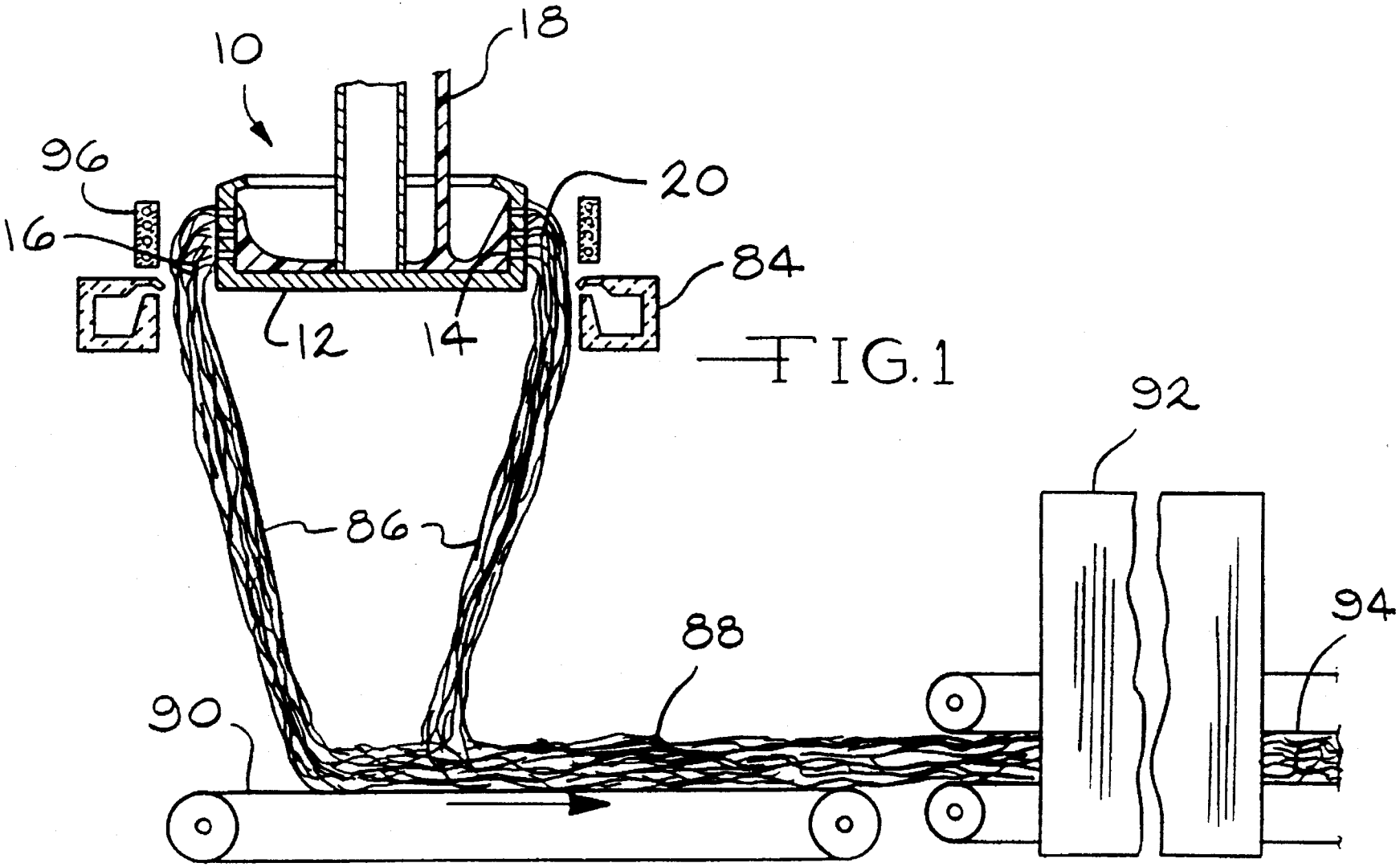
FIG. 1 is schematic sectional view in elevation of apparatus for centrifuging polymer fibers in accordance with the rotary process of this invention.

As shown in FIG. 1, the apparatus for producing hollow polymer fibers by a rotary process includes rotatably mounted polymer spinner 10 which is comprised generally of a bottom wall 12 and a peripheral wall 14. The spinner can be cast from nickel/cobalt/chromium alloy as used for the production of glass fibers, or can be any other suitable spinner such as one from welded stainless steel. The peripheral wall 14 has from about 200 to about 25,000 orifices 16 for the centrifugation of polymer fibers, preferably from about 200 to about 5,000 orifices, and more preferably from about 1,000 to about 3,000 orifices. The number of orifices is somewhat dependent upon the spinner diameter. As will be discussed below in relation to FIG. 2 but not shown in FIG. 1, tip assemblies 22 are located in the orifices 16.

Molten polymer is dropped into the rotating spinner 10 as feed stream 18. Alternatively the molten polymer can be fed to the spinner through pipes or other delivery conduits. The molten polymer can be produced or supplied by using extruder equipment commonly known to those in the art of polymeric materials, such as PET. The polymer can be any heat softenable polymer. Examples include, but are not limited to, polypropylene, poly(ethylene terephthalate-)("PET"), poly(phenylene sulfide)("PPS"), polycarbonate, polystyrene, polyethylene, poly(butylene terephthalate) ("PBT"), and polyamide. Both thermoplastic and thermoset polymers can be used.

Upon reaching the spinner bottom wall 12, the molten polymer is driven radially outwardly and up the peripheral wall 14 where centrifugal force centrifuges the polymer through the tip assemblies 22 located in the orifices 16 to form a plurality of hollow polymer fibers 20. The spinner 10 typically rotates at a speed from about 1200 rpm to about 3000 rpm, and preferably from about 1500 rpm to about 2000 rpm. Spinners of various diameters can be used, and the rotation rates adjusted to give the desired radial acceleration at the inner surface of the peripheral wall of the spinner. The spinner diameter is typically from about 8 inches (20.3 cm) to about 40 inches (101.6 cm), preferably from about 10 inches (25.4 cm) to about 25 inches (63.5 cm), and most preferably about 15 inches (38.1 cm). The radial acceleration (velocity$^2$/radius) of the inner surface of the peripheral wall of the spinner is from about 15,000 feet/second$^2$ (4,572 meters/second$^2$) to about 45,000 feet/second$^2$ (13,716 meters/second$^2$), and preferably from about 20,000 feet/second$^2$ (6,096 meters/second$^2$) to about 30,000 feet/second$^2$ (9,144 meters/second$^2$).

Figure 2:
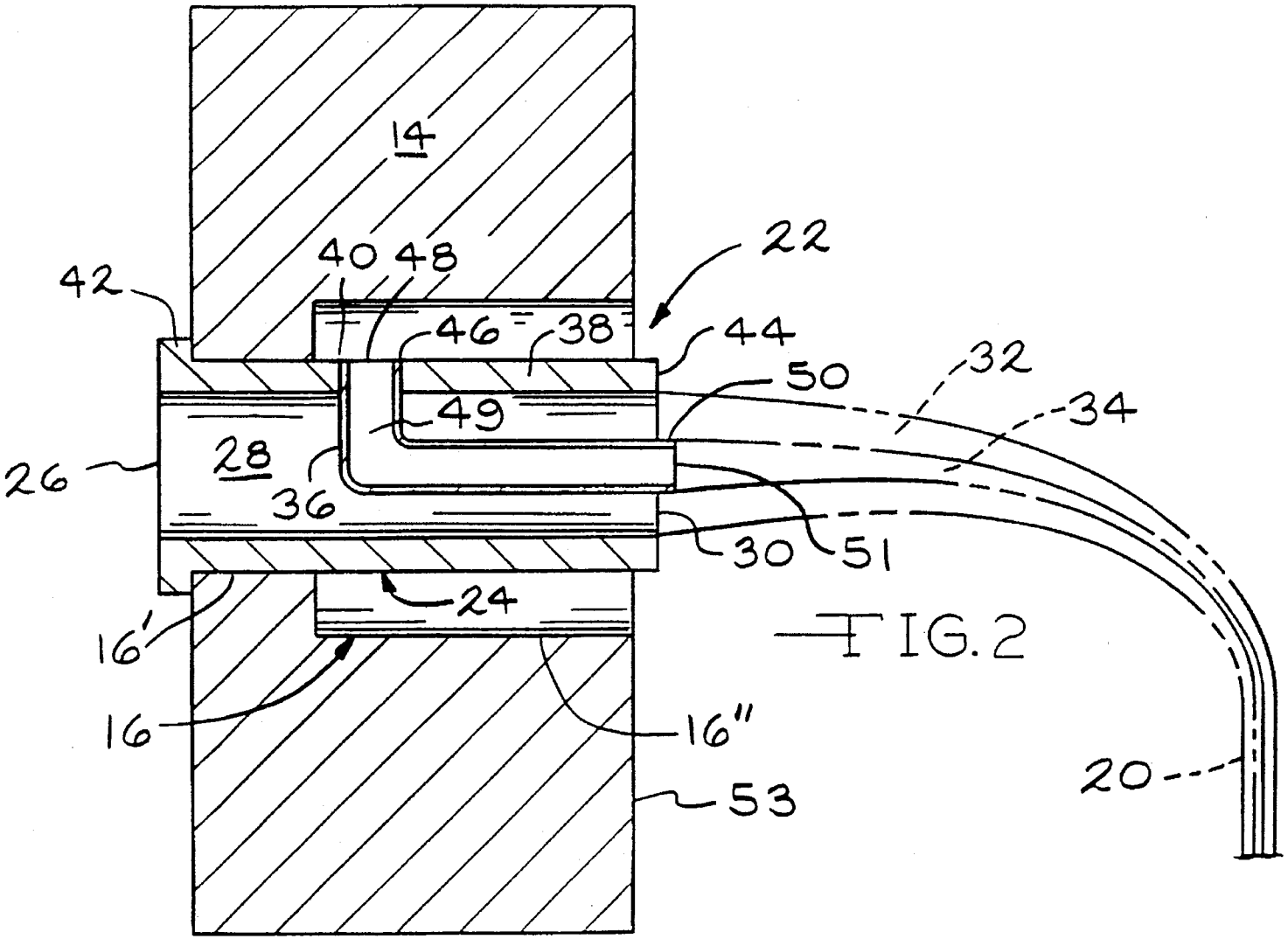
FIG. 2 is an enlarged cross-sectional view of a tip assembly located in the peripheral wall of a polymer spinner in accordance with this invention.

As can be seen in FIG. 2, tip assemblies 22 are located in the orifices 16 in the peripheral wall 14 of the spinner. Each tip assembly 22 includes a generally cylindrical first tube 24. The first tube 24 extends through the peripheral wall 14. The first tube 24 includes an inlet 26, a bore 28, and an outlet 30. Molten polymer is centrifuged through the first tube 24 to form fibers 20. The molten polymer flows from inside the spinner into the inlet 26, then through the bore 28, and then exits through the outlet 30. Preferably the molten polymer exiting the first tube 24 is reduced in diameter in a fiber forming cone 32 to form fibers 20. The cone 32 is formed where the molten polymer necks down from the diameter of outlet 30 of the first tube 24 to a smaller diameter.

Each tip assembly 22 is adapted to move or draw the gas immediately surrounding the tip assembly, and introduce it into the interior of the molten polymer. Preferably the gas is ambient air. However, the gas can also be nitrogen, argon, combustion gases or other suitable gases. By introducing gas into the interior of the molten polymer, continuous voids 34 are produced inside the polymer fibers to form hollow polymer fibers 20. Preferably the gas is introduced into the cone 32.

In the preferred embodiment shown in FIG. 2, the gas is introduced into the interior of the molten polymer through a second tube 36. Preferably, as shown in FIG. 2, the second tube 36 is positioned inside the first tube 24 in the peripheral wall 14 of the spinner. The illustrated second tube 36 is generally "L" shaped, but it can be any shape suitable for the sufficient flow of gas to form the voids in the fibers. In particular, first tube 24 includes a sleeve 38 having an aperture 40 located intermediate shoulder 42 and distal end 44. First end 46 of second tube 36 is attached to sleeve 38 at aperture 40. Thus, inlet 48 of passageway 49 of second tube 36 is in communication with the region immediately adjacent to exterior of first tube 24. Distal end 50 of second tube 36, and thus outlet 51 of passageway 49, are located near the distal end 44 of first tube 24. In the illustrated embodiment, outlet 51 is located slightly outside the distal end 44, but the outlet 51 can also be located even with or slightly inside the distal end 44.

As a result of the above-described structure, the inlet 48 of the second tube 36 is open to ambient gas pressure immediately surrounding the tip assembly 22, outside the peripheral wall of the spinner. The outlet 51 of the second tube 36 is located near the outlet 30 of the first tube 24. As the molten polymer flows through the annulus formed between first tube 24 and second tube 36, gas in the forming region or zone is aspirated through passageway 49 of second tube 36 into the cone 32 being attenuated into a fiber 20, thereby forming a hollow polymer fiber 20. The fiber is generally circular in radial cross section because the bore 28 of the first tube 24 has a circular radial cross section.

Preferably the inlet 48 of the second tube 36 is positioned away from the distal end 44 of the first tube 24, a distance at least as great as the inside diameter of the second tube 36 at the outlet 51. This positioning ensures an optimum flow of gas into the hollow polymer fibers.

In the preferred embodiment illustrated in FIG. 2, the tip assembly 22 is positioned mostly inside the peripheral wall 14 of the spinner, i.e., in the direction of the thickness of the peripheral wall. Specifically, the inlet 48 of the second tube 36 is positioned inside the peripheral wall 14. The orifice 16 in the peripheral wall 14 is generally cylindrical and includes a smaller diameter portion 16' and a larger diameter portion 16". The tip assembly 22 depends from the smaller diameter portion 16'. The larger diameter portion 16" has a diameter that is greater than the outer diameter of the first tube 24. As a result, gas can be introduced into the inlet 48 of the second tube 36. Preferably the diameter of the larger diameter portion 16" is at least about 0.010 inch (0.025 cm) greater than the outside diameter of the first tube 24.

It has been found that the tip assembly 22 for making hollow polymer fibers in accordance with this invention must be significantly smaller than a tip assembly for making hollow glass fibers by a textile process such as disclosed in U.S. Pat. No. 4,846,864 to Huey, issued Jul. 11, 1989. The length of the first tube 24 is preferably from about 0.050 inch (0.127 cm) to about 0.300 inch (0.762 cm), and more preferably about 0.190 inch (0.483 cm). The inside diameter of the first tube 24 at the outlet 30 is preferably from about 0.040 inch (0.102 cm) to about 0.150 inch (0.381 cm), and more preferably about 0.063 inch (0.160 cm). The inside diameter of the second tube 36 at the outlet 51 is preferably from about 0.015 inch (0.038 cm) to about 0.120 inch (0.305 cm), and more preferably about 0.033 inch (0.084 cm). The outside diameter of the second tube 36 at the outlet 51 is preferably from about 0.020 inch (0.051 cm) to about 0.140 inch (0.356 cm), and more preferably about 0.051 inch (0.130 cm).

Distal end 50 of second tube 36 is preferably positioned somewhere in the region ranging from within the distal end 44 of first tube 24 a distance equal to about twice the outside diameter of the second tube 36, to beyond distal end 44 of first tube 24 a distance equal to about twice the outside diameter of the second tube 36. More preferably, distal end 50 of second tube 36 is either about flush with distal end 44 of first tube 24 or extending therefrom up to and including a distance equal to about the outside diameter of the second tube 36.

In FIG. 2, the outlet 51 of second tube 36 is generally concentric with the outlet 30 of first tube 24. This produces a hollow polymer fiber having a generally centrally located continuous void. It is to be understood, however, that other orientations are acceptable. A variation includes having a non-concentric alignment between the outlets 51 and 30. In addition to having a non-concentric alignment, bore 28 of first tube 24 may have a non-circular radial cross section to enable the formation of non-circular fibers, or second tube 36 may have a non-circular radial cross section to enable the formation of non-circular voids. The tubes can have any number of shapes and orientations.

In the illustrated embodiment, the gas is dram into the interior of the cone 32 by the fact that the internal pressure of the molten polymer at that location is subatmospheric due to, among other things, the attenuation of the cone 32 into a fiber 20. That is, no outside source of pressurized gas is needed to produce the hollow configuration. However, it is to be understood that the present invention can be adapted to be utilized in conjunction with a pressurized system, as disclosed in U.S. Pat. No. 4,846,864 to Huey, issued Jul. 11, 1989 (incorporated by reference herein).

The hollow nature of the fibers can be quantified in terms of their void fraction, which is defined as $(D_i/D_o)^2$, where $D_i$ is the inside diameter and $D_o$ is the outside diameter of the fiber. The average void fraction of the hollow polymer fibers is dependent on the polymer viscosity, the pressure of the gas, and the tip assembly design, particularly the diameter of the outlet 51 of the second tube 36. The average void fraction of the hollow polymer fibers can be varied from very small (about 10%) to very large (about 80–90%). Preferably the average void fraction is from about 20% to about 60%. Even though the polymer fibers in accordance with this invention have been called "hollow", they can include some parts that are solid and will still be considered hollow.

Figure 3:
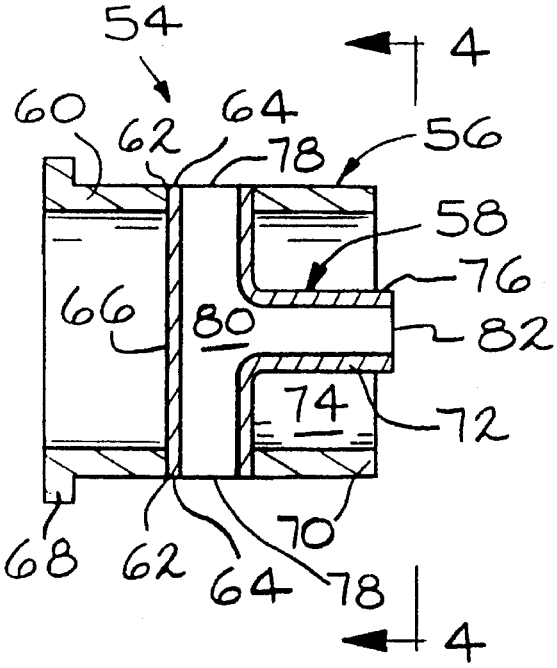
FIG. 3 is an enlarged cross-sectional view of a second embodiment of a tip assembly in accordance with this invention.
Figure 4:
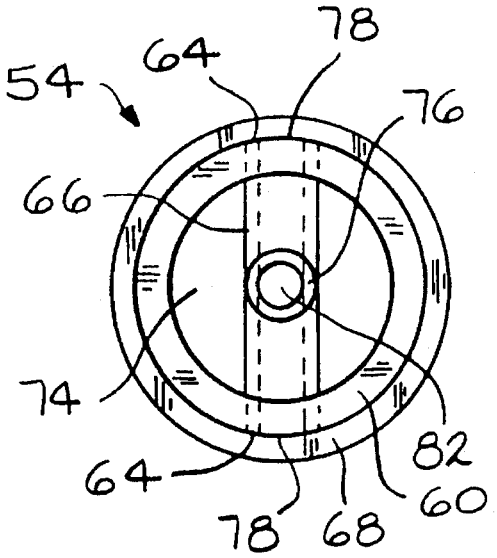
FIG. 4 is a side view of the tip assembly of FIG. 3, as shown along line 44.

The design of tip assembly 54 shown in FIGS. 3 and 4 incorporates a generally "T" shaped second tube 58 attached within first tube 56 at a plurality of locations. Sleeve 60 of first tube 56 contains opposed apertures 62 which are adapted to receive ends 64 of beam 66 of second tube 58. Apertures 62 are located intermediate shoulder 68 and distal end 70 of sleeve 60. Projection 72 of second tube 58 extends from beam 66 substantially concentrically, outwardly through bore 74 of first tube 56. Distal end 76 of projection 72 is located at distal end 70 of first tube 56. Thus, the gas of the region immediately outside the peripheral wall 14 of the spinner and surrounding first tube 56 will be drawn into inlets 78 of passageway 80 of second tube 58 and exhausted at outlet 82 thereof at distal end 76 according to the principles of this invention.

Figure 5:
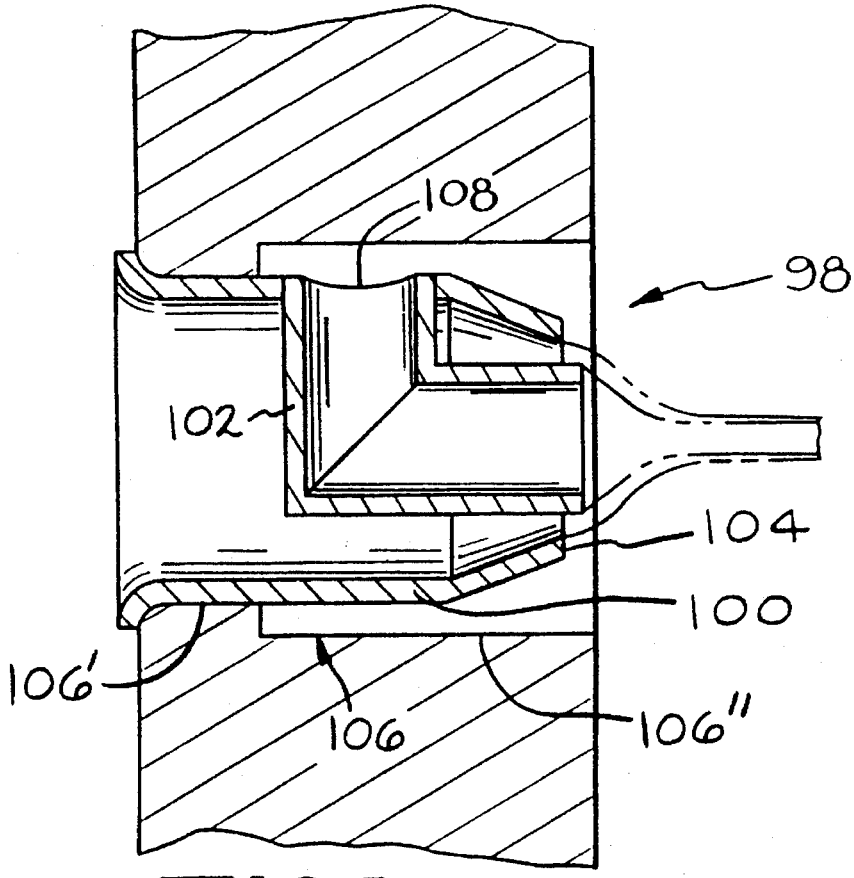
FIG. 5 is an enlarged cross-sectional view of a third embodiment of a tip assembly in accordance with this invention.

The tip assembly 98 shown in FIG. 5 includes a generally "L" shaped second tube 102 positioned inside a first tube 100. The first tube 100 is similar in structure to the first tube 24 shown in FIG. 2, but its distal end 104 is radially narrowed and it does not extend outside the orifice 106 in the peripheral wall of the spinner. The tip assembly 98 also has larger diameter first and second tubes 100 and 102 than the tip assembly 22 shown in FIG. 2. The orifice 106 includes a smaller diameter portion 106' and a larger diameter portion 106". The larger, diameter portion 106" has a diameter that is greater than the diameter of the first tube 100 so that gas can be introduced into the inlet 108 of the second tube 102.

Figure 6:
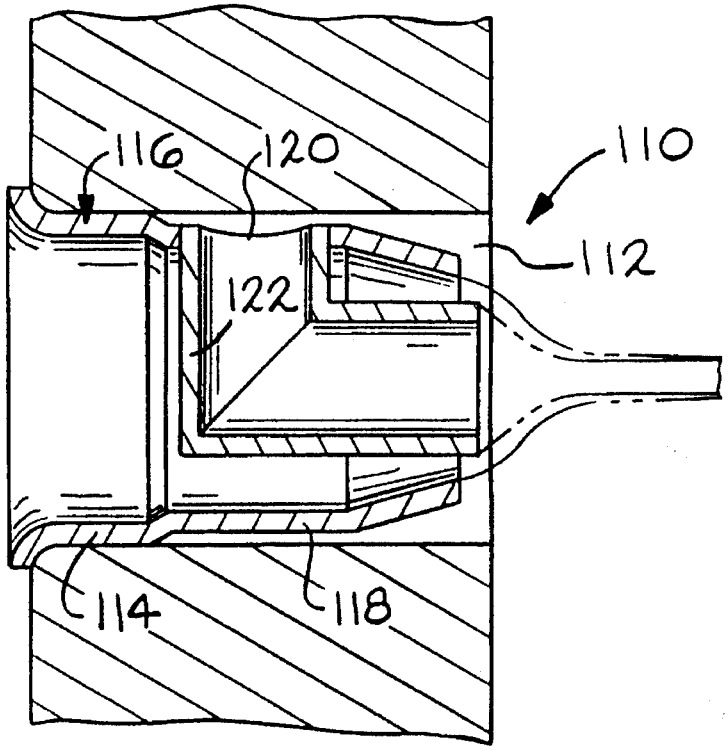
FIG. 6 is an enlarged cross-sectional view of a fourth embodiment of a tip assembly in accordance with this invention.

FIG. 6 shows a tip assembly 110 similar to the tip assembly 98 of FIG. 5. However, the orifice 112 does not include a larger diameter portion. Rather, the first tube 116 is necked down from a wide portion 114 to a narrowed portion 118 so that gas can be introduced into the inlet 120 of the second tube 122.

Figure 7:
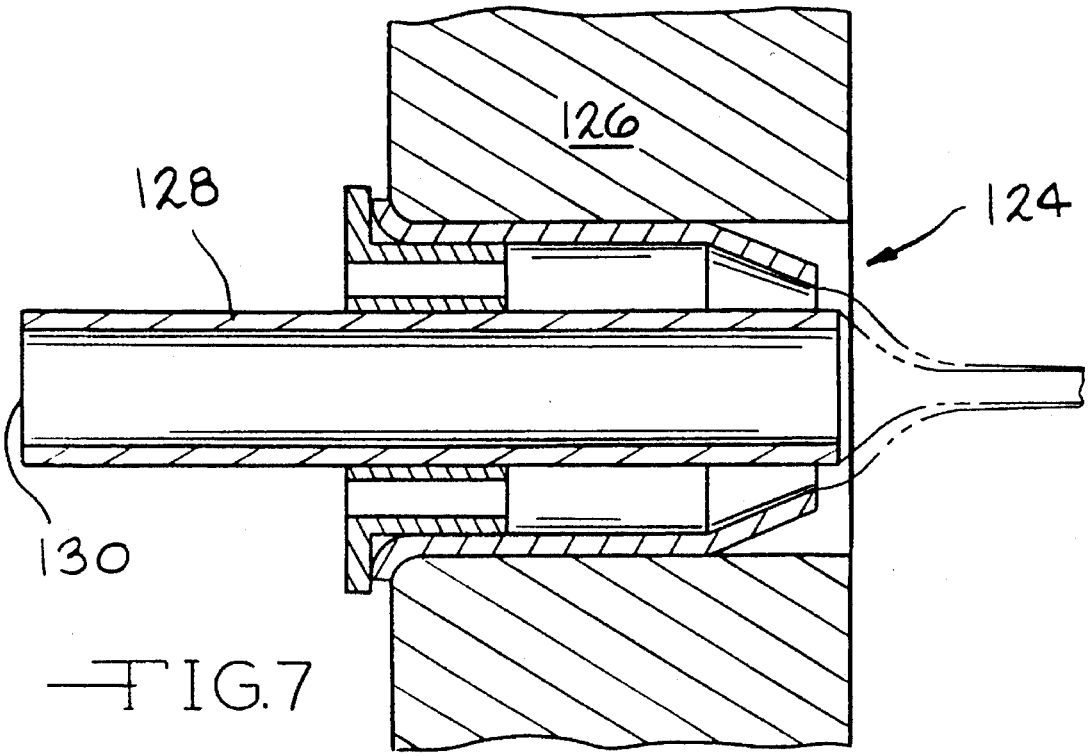
FIG. 7 is an enlarged cross-sectional view of a fifth embodiment of a tip assembly in accordance with this invention.

The tip assembly 22 shown in FIG. 2 draws gas from outside the peripheral wall 14 of the spinner. However, the invention is not limited thereto. FIG. 7 shows a tip assembly 124 that draws gas from inside the peripheral wall 126 of the spinner. The second tube 128 extends inside the peripheral wall 126 a sufficient distance to be inside the molten polymer being centrifuged through the peripheral wall. In this manner, gas can be introduced into the inlet 130 of the second tube from inside the spinner.

Figure 8:
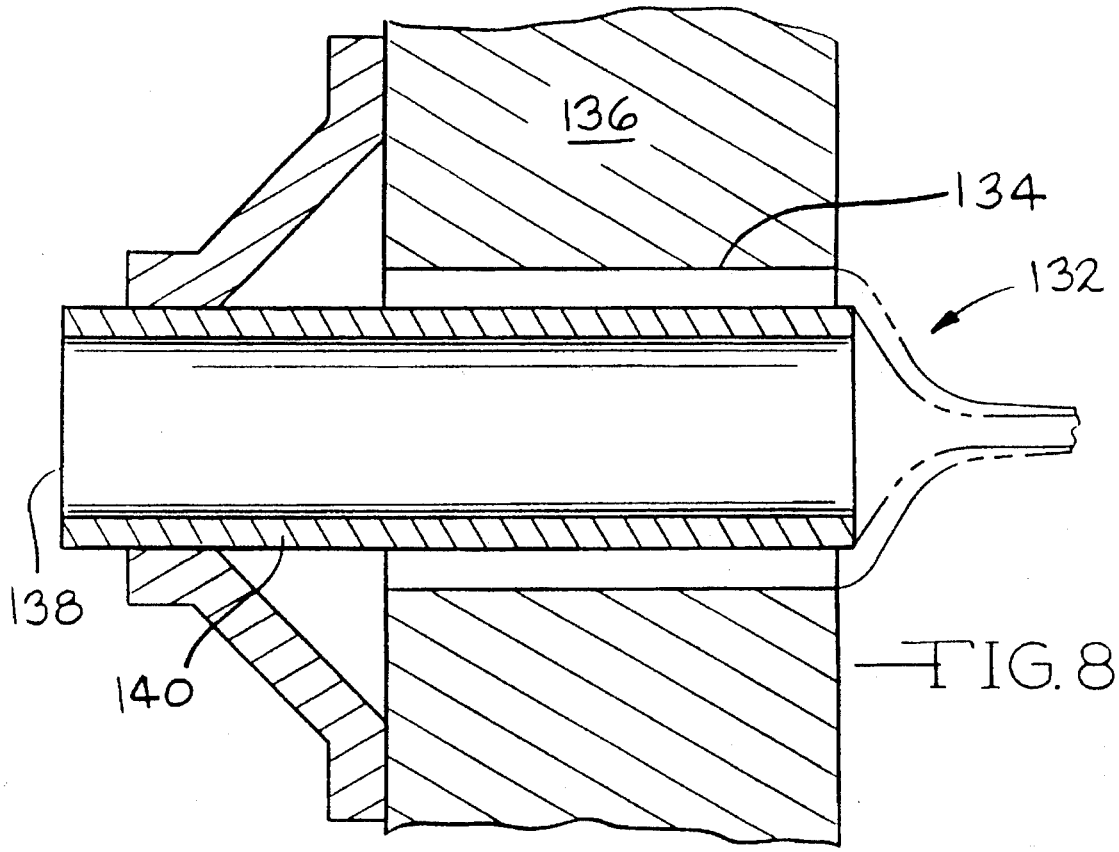
FIG. 8 is an enlarged cross-sectional view of a sixth embodiment of a tip assembly in accordance with this invention.

In the tip assembly 22 shown in FIG. 2, the first tube 24 has been illustrated as a separate structure. However, FIG. 8 shows a tip assembly 132 where the orifice 134 in the peripheral wall 136 of the spinner comprises the first tube. The first tube is not a separate structure apart from the orifice 134. This embodiment also shows gas being introduced through an inlet 138 of the second tube 140 from inside the spinner.

Figure 9:
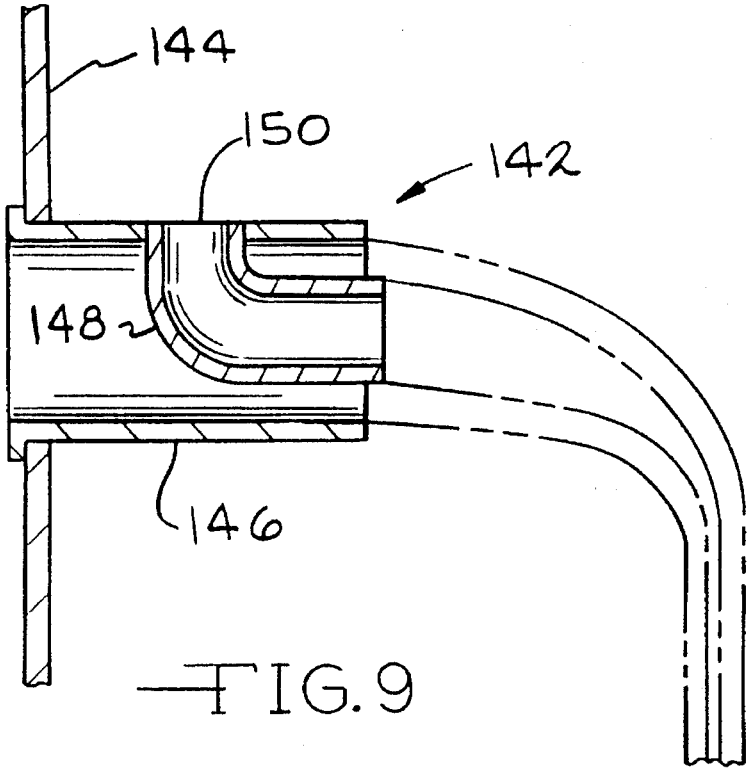
FIG. 9 is an enlarged cross-sectional view of a seventh embodiment of a tip assembly in accordance with this invention.

FIG. 9 shows a tip assembly 142 that extends mostly outside the peripheral wall 144 of the spinner instead of being positioned mostly inside the peripheral wall. The first tube 146 extends from the peripheral wall 144. The second tube 148 is positioned inside the first tube 146. The inlet 150 of the second tube 148 is positioned outside the peripheral wall 144 so that gas can flow freely into the inlet as the spinner rotates. In the tip assembly 142 of FIG. 9, the inlet 150 of the second tube 148 is oriented generally in the upward direction. However, a benefit of the rotary process when the tip assembly 142 extends mostly outside the peripheral wall 144 of the spinner is that the pressure of gas flowing through the inlet 150 can be adjusted by changing the position of the inlet. If the inlet 150 is oriented generally in the forward direction (the direction of rotation of the spinner), gas is forced through the inlet to increase the gas pressure. The mount of void in the hollow polymer fibers can be increased by increasing the pressure of the gas introduced into their interior.

Other suitable configurations for the first and second tubes are disclosed in the above-cited U.S. Pat. No. 4,846,864 to Huey. The Huey patent also discloses "tipless" designs which, as disclosed above, are an alternative embodiment for forming the hollow polymer fibers. It is to be understood that the spinner/tip assemblies of the present invention can be utilized to form discontinuous as well as the continuous fibers if desired.

Referring again to FIG. 1, after emanating from the tip assemblies 22 of the spinner 10, the hollow polymer fibers 20 are directed downwardly by annular blower 84 to form a downwardly moving flow or veil 86 of hollow polymer fibers. Any means can be used for turning the fibers from a generally radially outward path to a path directed toward a collection surface. The hollow polymer fibers 20 are collected as hollow polymer fiber web 88 on any suitable collection, surface, such as conveyor 90.

Centrifugal attenuation by the rotation of the spinner is sufficient to produce hollow polymer microfibers having an average outside diameter of from about 10 one-hundred thousandths of an inch (about 2.5 microns) to about 250 one-hundred thousandths of an inch (about 62.5 microns), preferably from about 10 one-hundred thousandths of an inch (about 2.5 microns) to about 100 one-hundred thousandths of an inch (about 25 microns), and more preferably from about 15 one-hundred thousandths of an inch (about 3.75 microns) to about 50 one-hundred thousandths of an inch (about 12.5 microns). A smaller tip design, a lower throughput, and a less viscous polymer all will generally produce smaller fibers. If desired, annular blower 84 can be supplied with sufficient gas pressure to facilitate attenuation of the fibers. The fibers could also be chemically treated to reduce their outside diameter.

The total throughput of the method is preferably from about 5 lbs/hr (2.27 kg/hr) to about 750 lbs/hr (340.5 kg/hr), more preferably from about 10 lbs/hr (4.54 kg/hr) to about 250 lbs/hr (113.5 kg/hr), and most preferably from about 80 lbs/hr (36.32 kg/hr) to about 250 lbs/hr (113.5 kg/hr). The throughput is dependent on a number of variables including the size of the spinner and the number of orifices.

Subsequent to the hollow polymer fiber forming step, the hollow polymer fiber web 88 can be transported through any further processing steps, such as oven 92, to result in the final hollow polymer fiber product, such as mat 94. Further processing steps could also include laminating the hollow polymer fiber mat or layer with a reinforcement layer, such as a glass fiber mat.

An optional feature of the invention is the use of a heating means, such as induction heater 96, to heat either the spinner 10, or the hollow polymer fibers 20, or both, to facilitate the hollow polymer fiber attenuation and maintain the temperature of the spinner at the level for optimum centrifugation of the polymer into hollow fibers. The spinner 10 can also be heated by pressurized heated air forced against the inside of the spinner, for example from a hot air chamber positioned inside the spinner. Most of the hot air will vent from the top of the spinner, but part of the hot air can be vented through the bottom of the spinner through a series of holes. Other heating means for the spinner can be employed, such as electric resistance heating. The temperature of the spinner is preferably from about 300° F. (149° C.) to about 500° F. (260° C.) for polypropylene, and can vary for other polymers.

EXAMPLE

Polypropylene was extruded, and delivered to a polymer spinner at a temperature of about 400° F. (204° C.). The polymer spinner was rotated so as to provide a radial acceleration of 25,000 feet/second$^2$ (7,620 meters/second$^2$). The spinner peripheral wall was adapted with 350 orifices. Tip assemblies as shown in FIG. 2 were located in the orifices. The length of the first tube 24 of the tip assembly was 0.190 inch (0.483 cm), and it had an inside diameter of 0.063 inch (0.16 cm) at its outlet. The inside diameter of the second tube 36 at its outlet was 0.033 inch (0.084 cm), and its outside diameter at its outlet was 0.051 inch (0.13 cm). Total spinner throughput was 20 lbs/hour (9.07 kg/hour) of hollow polypropylene fibers from the spinner. There was no external heating from an induction heater and no attenuation from an annular blower. The hollow polypropylene fibers were collected as a mat. More than 90% of the fibers produced were hollow. The hollow polypropylene fibers had an average void fraction of 40%. The average outside diameter of the fibers was 32 one-hundred thousandths of an inch (8 microns).

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

INDUSTRIAL APPLICABILITY

The invention can be useful in the manufacturing of hollow polymer fibers for use in absorbent and filtration products, and acoustical and insulation products.

We claim:

1. A method for producing hollow polymer fibers comprising:

supplying molten polymer to a rotating polymer spinner having a peripheral wall;

centrifuging the molten polymer through a first tube extending through the peripheral wall of the spinner to form fibers;

introducing gas into the interior of the molten polymer to form hollow polymer fibers; and collecting the hollow polymer fibers.

2. A method according to claim 1 wherein gas is introduced into the interior of the molten polymer through a second tube positioned inside the first tube.

3. A method according to claim 2 wherein the second tube includes an inlet positioned in the wall of the first tube, and wherein gas is introduced through the inlet from outside the peripheral wall of the spinner.

4. A method according to claim 3 wherein the first tube is positioned in an orifice in the peripheral wall of the spinner, wherein the inlet of the second tube is positioned inside the peripheral wall of the spinner, and wherein the orifice and the first tube together are adapted to allow the flow of gas to the inlet.

5. A method according to claim 4 wherein the orifice includes a larger diameter portion extending inward from the outer surface of the peripheral wall, wherein the diameter of the larger diameter portion is at least about 0.010 inch (0.025 cm) greater than the outside diameter of the first tube, and wherein the inlet of the second tube is positioned inside the larger diameter portion.

6. A method according to claim 3 wherein the inlet of the second tube is positioned outside the peripheral wall of the spinner, and wherein the inlet is oriented generally in the forward direction.

7. A method according to claim 2 wherein the second tube includes an outlet, and wherein the inside diameter of the second tube at the outlet is from about 0.015 inch (0.038 cm) to about 0.120 inch (0.305 cm).

8. A method according to claim 2 wherein the first tube includes an outlet, and wherein the inside diameter of the first tube at the outlet is from about 0.040 inch (0.102 cm) to about 0.150 inch (0.381 cm).

9. A method according to claim 2 wherein the molten polymer exiting the first tube is reduced in diameter in a fiber forming cone, and wherein gas is introduced through rite second tube into the cone.

10. A method according to claim 3 wherein the first tube includes a distal end, and wherein the inlet of the second tube is positioned away from the distal end a distance at least as great as the inside diameter of the second tube at its outlet.

11. A method according to claim 1 wherein the total throughput of the method is from about 5 lbs/hr (2.27 kg/hr) to about 750 lbs/hr (340.5 kg/hr).

12. A method according to claim 1 wherein the polymer is selected from the group consisting of polypropylene, poly(ethylene terephthalate), poly(phenylene sulfide), polycarbonate, polystyrene, polyethylene, poly(butylene terephthalate), polyamide, and mixtures thereof.

13. A method according to claim 1 wherein from about 200 to about 5,000 first tubes extend through the peripheral wall of the spinner.

14. A method according to claim 1 wherein the radial acceleration of the inner surface of the peripheral wall of the spinner is from about 15,000 feet/second$^2$ (4,572 meters/second$^2$) to about 45,000 feet/second$^2$ (13,716 meters/second$^2$).

15. A method according to claim 1 wherein the spinner rotates at a speed from about 1200 rpm to about 3000 rpm.

16. A method according to claim 1 wherein the diameter of the spinner is from about 8 inches (20.3 cm) to about 40 inches (101.6 cm).

17. A method according to claim 1 wherein the average void fraction of the hollow polymer fibers is from about 20% to about 60%.

18. A method for producing hollow polymer fibers comprising:

supplying molten polymer to a rotating polymer spinner having a peripheral wall, wherein the radial acceleration of the inner surface of the peripheral wall of the spinner is from about 20,000 feet/second$^2$ (6,096 meters/second$^2$) to about 30,000 feet/second$^2$ (9,144 meters/second$^2$);

centrifuging the molten polymer through a first tube extending through the peripheral wall of the spinner, wherein the molten polymer exiting the first tube is reduced in diameter in a fiber forming cone to form fibers;

introducing gas into the cone through a second tube positioned inside the first tube to form hollow polymer fibers; and collecting the hollow polymer fibers.

* * * * *

UNITED STATES PATENT AND TRADEMARK OFFICE

CERTIFICATE OF CORRECTION

PATENT NO. : 5,622,671

DATED : April 22, 1997

INVENTOR(S) : Michael T. Pellegrin et al.

It is certified that error appears in the above-indentified patent and that said Letters Patent is hereby corrected as shown below:

In Claim 9, Line 3, "rite" should be - -the - -.

Signed and Sealed this

Eighth Day of July, 1997

Bruce Lehman

*Attest:*

BRUCE LEHMAN

*Attesting Officer*

*Commissioner of Patents and Trademarks*